US007413186B2

(12) United States Patent
Koga et al.

(10) Patent No.: US 7,413,186 B2
(45) Date of Patent: Aug. 19, 2008

(54) FEEDING DEVICE, DUST REMOVER, AND DATA PROCESSING APPARATUS

(75) Inventors: Yuji Koga, Nagoya (JP); Masahiko Sasa, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 55 days.

(21) Appl. No.: 11/017,133

(22) Filed: Dec. 21, 2004

(65) Prior Publication Data

US 2005/0140083 A1 Jun. 30, 2005

(30) Foreign Application Priority Data

Dec. 26, 2003 (JP) ..... 2003-431810

(51) Int. Cl.
*B65H 1/00* (2006.01)

(52) U.S. Cl. ..... 271/145

(58) Field of Classification Search ..... 271/147, 271/31, 152, 155, 220, 169, 145–151, 161–171, 271/21, 127; 347/104; 399/377, 393; 358/498; 15/104.92, 93.4; 400/624, 629
See application file for complete search history.

(56) References Cited

U.S. PATENT DOCUMENTS 2,462,789 A * 2/1949 Trollen ..... 206/449
5,220,393 A * 6/1993 Otomo ..... 399/125
5,269,508 A * 12/1993 Hattori ..... 271/171
5,480,247 A * 1/1996 Saikawa et al. ..... 400/629
5,825,513 A * 10/1998 Hasegawa ..... 358/498
6,089,566 A * 7/2000 Xu et al. ..... 271/265.01
6,250,629 B1 * 6/2001 Brown et al. ..... 271/220
6,550,636 B2 * 4/2003 Simpson ..... 221/59
6,939,068 B2 * 9/2005 Rawlings et al. ..... 400/718
6,956,679 B2 * 10/2005 Hatano ..... 358/474

FOREIGN PATENT DOCUMENTS

JP A-09-018642 1/1997
JP A-2001-048359 2/2001
JP A-2001-086290 3/2001
JP A-2001-096726 4/2001
JP A-2002-128365 5/2002
JP A-2002-273981 9/2002

* cited by examiner

*Primary Examiner*—Patrick Mackey
*Assistant Examiner*—Jeremy Severson
(74) *Attorney, Agent, or Firm*—Oliff & Berridge, PLC

(57) ABSTRACT

A feeding device capable of feeding sheets one after another in a feed direction, including: (a) a sheet accommodator capable of accommodating the sheets piled therein; and (b) a dust remover including a contact portion which is held in contact with a surface of an uppermost one of the sheets piled in the sheet accommodator so as to remove dust from the surface of the uppermost sheet that is fed from the sheet accommodator in the feed direction. Also disclosed is a data processing apparatus including: (i) the above-described feeing device; and (ii) at least one of an image reader and a printer head, to which the sheets are fed to be subjected to respective operations achieved by the above-described at least one of the image reader and the printer head.

29 Claims, 12 Drawing Sheets

FEEDING DEVICE, DUST REMOVER, AND DATA PROCESSING APPARATUS

This application is based on Japanese Patent Application No. 2003-431810 filed in Dec. 26, 2003, the contents of which are incorporated hereinto by reference.

BACKGROUND OF THE INVENTION

1. Field of the Invention

The present invention relates to a feeding device for feeding sheets, a dust remover which is to be incorporated in the feeding device, and a data processing apparatus such as a printer and a facsimile incorporating the feeding device and the dust remover. More particularly, the invention is concerned with a technique for removing dust from surfaces of the sheets which are piled in a sheet accommodator of the device or apparatus and which are to be fed toward an inside of the device or apparatus, for thereby preventing a large amount of dust from being accumulated in the inside of the device or apparatus.

2. Discussion of Related Art

There is known an automatic sheet feeder, which is incorporated in a recording apparatus such as an inkjet printer, for feeding recording media (e.g., cut paper sheets) toward an inside of the apparatus, so that each recording medium is subjected to a recording operation achieved by a recording portion of the apparatus. The sheet feeder includes a medium accommodator (e.g., slanted tray) for accommodating the recording media piled therein, so that the media are supplied or fed one after another from the medium accommodator toward the recording portion. If the recording media are left on the medium accommodator for a long period of time, a large amount of dust could collect on the recording media, particularly, on an exposed surface of an uppermost one of the piled media. The large amount of the collecting dust, when the recording medium is fed to the recording portion, are likely to be carried by the recording medium to the recording portion, thereby possibly causing clogging of nozzles of the recording portion and the consequent deterioration in a quality of recording.

JP-A-2001-48359 discloses a dust cover which serves to solve the above-described problem. This dust cover is provided by a lid-like member which is formed from a single rectangular plate made of synthetic resin and having four sides. The lid-like dust cover has a top wall, three side walls which are formed by bending three of the four sides of the rectangular plate so as to be held in perpendicular to the top wall, and an opening which is defined by the top wall and mutually opposed two of the three side walls. The lid-like dust cover is used to cover an upper surface of a stacker of a cut-sheet feeder, by disposing the dust cover on the cut-sheet feeder, with the opening of the dust cover being directed downwardly. However, the lid-like dust cover has to be necessarily given a large length or height, since it is designed to cover an entirety of the upper surface of the stacker and an entire surface of each of cut sheets piled on the stacker. Further, in a process of manufacturing the lid-like dust cover, it is necessary to bend the sides of the resin-made rectangular plate having such a large size that permits the plate to cover the entire surface of each cut sheet, thereby requiring a cumbersome operation and a high cost for the manufacture.

JP-A-2002-273981 discloses an arrangement in which a recorder cover member is pivotably attached to a housing member of a printer while a sheet-feeder cover member is pivotably attached at its proximal end portion to the recorder cover member. The sheet-feeder cover is constantly held in contact at its distal end portion with an upper end of a rearwardly-inclined back wall of a sheet feeder, so as to be held in its closed position. The sheet-feeder cover has a recess formed in its distal end portion (see FIG. 4 of JP-A-2002-273981) and having a width which is larger than a width of sheets piled on the back wall of the sheet feeder, for thereby permitting the piled sheets to extend upwardly through the recess while the sheet-feeder cover is being held in its closed position. However, due to a gap between a bottom of the recess and a surface of an uppermost one of the piled sheets, it is not possible to satisfactorily prevent dust from entering a space between the surface of the uppermost sheet and a guide surface of the housing member (which is opposed to the back wall of the sheet feeder). That is, in this arrangement, the above-described conventional problem still can not be solved.

SUMMARY OF THE INVENTION

The present invention was made in view of the background prior art discussed above. It is therefore a first object of the invention to provide a feeding device which is capable of feeding sheets one after another while effectively removing dust from the surface of each sheet so as to restrain the dust from being carried to an inside of the feeding device. It is a second object of the invention to provide a dust remover which is to be incorporated in the feeding device and which has a simple construction with small weight and size. It is a third object of the invention to provide a data processing apparatus such as a printer in which the feeding device and the dust remover are incorporated. The first, second and third objects may be achieved according to first, second and third aspects of the invention, respectively, which are described below.

The first aspect of the invention provides a feeding device capable of feeding sheets one after another in a feed direction. The feeding device includes (a) a sheet accommodator capable of accommodating the sheets piled therein; and (b) a dust remover including a contact portion which is held in contact with a surface of an uppermost one of the sheets piled in the sheet accommodator so as to remove dust from the surface of the uppermost sheet that is fed from the sheet accommodator in the feed direction. It is noted that the term "dust" used herein is interpreted to include particle, grain, dirt, powder and any other foreign matter which could accidentally stick to the sheets.

The second aspect of the invention provides a dust remover which is to be incorporated in a feeding device capable of feeding sheets one after another from a sheet accommodator in which the sheets can be piled. The dust remover is configured to be constantly held in contact with a surface of an uppermost one of the piled sheets so as to remove dust from the surface of the uppermost sheet that is fed from the sheet accommodator.

The third aspect of the invention provides a data processing apparatus including: (i) the feeing device which is defined in the first aspect of the invention; and (ii) at least one of an image reader and a printer head, to which the sheets are fed to be subjected to respective operations achieved by the above-described at least one of the image reader and the printer head.

In the feeding device constructed according to the first aspect of the invention, since the dust remover is held in contact at its contact portion with the surface of the uppermost one of the sheets piled in the sheet accommodator, the dust can be reliably removed from the surface of the uppermost sheet as the sheet is fed from the sheet accommodator in the feed direction. The feeding device according to the first aspect can be advantageously incorporated in a data processing apparatus, as in the third aspect of the invention.

According to the second aspect of the invention, since the dust remover is configured to be constantly held in contact with the surface of the uppermost one of the piled sheets, the dust can be reliably removed from the surface of the uppermost sheet in the feeding device which incorporates the dust remover.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

Figure 1:
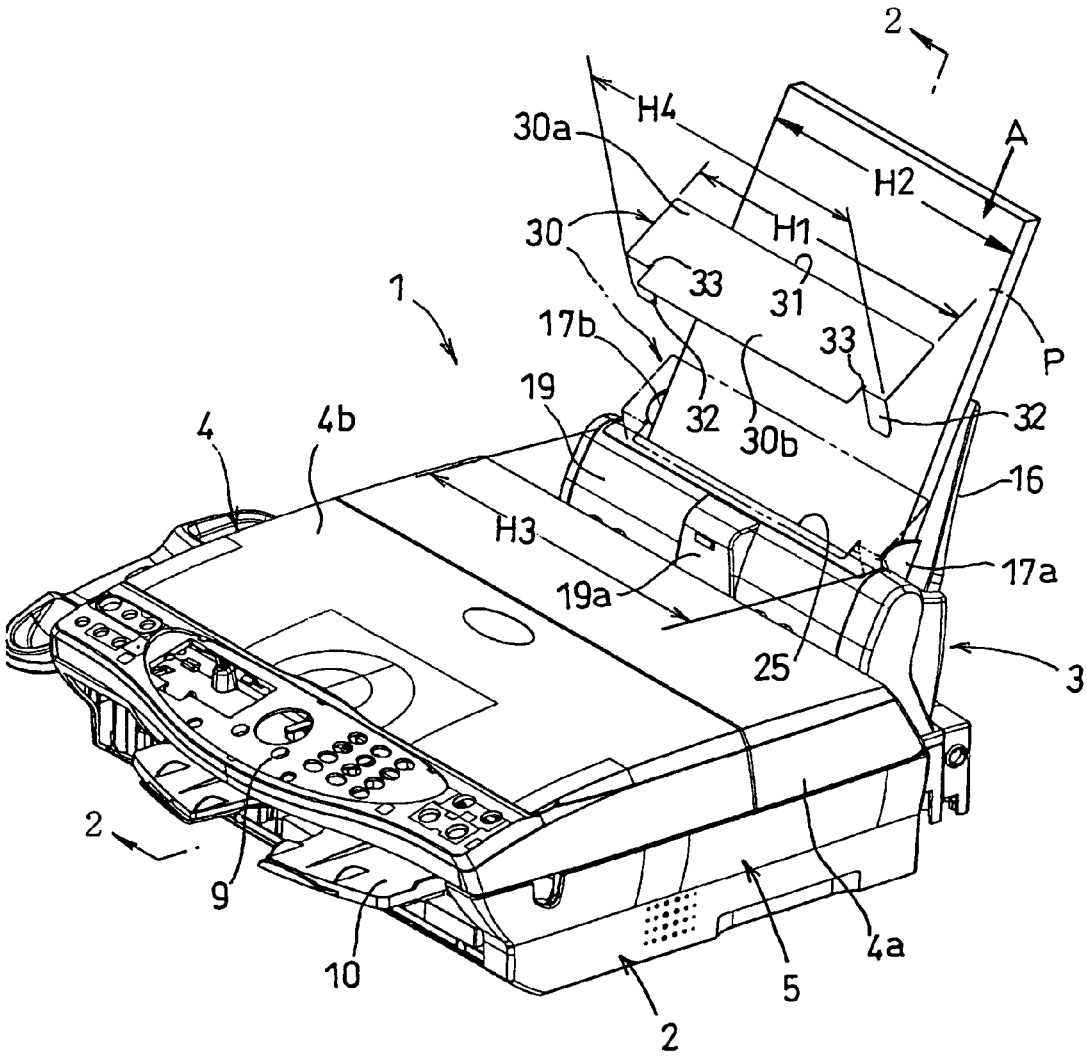
FIG. 1 is a perspective view of a multifunction device incorporating a dust remover which is constructed according to a first embodiment of the invention.

Referring first to FIGS. 1-5, there will be described a first embodiment of the invention. FIG. 1 shows a data processing apparatus in the form of a multifunction device 1 having printer, copier, scanner and facsimile functions. This multifunction device 1 includes: a casing body 2; an automatic sheet feeder 3 as a feeding device which is disposed on a rear side of the casing body 2; an image reader 4 which is disposed forwardly and upwardly of the automatic sheet feeder 3 and is operable to achieve copying and scanning operations; an inkjet printer 5 which is disposed below the image reader 4 and is operable to achieve a printing operation; and a sheet exit tray 10 which is disposed on a front side of the inkjet printer 5 so as to receive a paper sheet P as a recording medium which has been subjected to one of the above-described operations.

The image reader 4 is arranged to be pivotable about a horizontal axis (not shown) located in its rear end portion, so as to be vertically pivotable relative to the casing body 2. The image reader 4 includes a scanner device (not shown), a casing member 4*a* and a cover member 4*b* which covers a glass plate 6 disposed on an upper surface of the casing member 4*a*. The cover member 4*b* is arranged to be pivotable about an horizontal shaft 8 located in its rear end portion, so as to be vertically pivotable relative to the casing member 4*a*, namely, so as to be pivotable between its horizontal position and vertical position for covering and exposing the glass plate 6. This cover member 4*b* is placed in its vertical position, when the glass plate 6 needs to be exposed, for example, for setting of an original thereon. The scanner device is disposed right below the glass plate 6 and is arranged to be reciprocatable relative to the casing body 2 in right and left directions (i.e., in directions perpendicular to drawing sheet of FIG. 2).

In a lower front portion of the casing body 2, there are provided four ink cartridges 7 storing a black ink, a cyan ink, a magenta ink, and a yellow ink, respectively, so that the four color inks can be used by the inkjet printer 5 for achieving a full-color printing operation. The ink cartridges 7, each provided by a flat container, are disposed below a sheet feed path (along which the paper sheet P is to be fed), and are held in respective cartridge holders so as to extend in substantially parallel with the sheet feed path. The four color inks are delivered from the respective ink cartridges 7 toward a head unit 11 of the inkjet printer 5 via ink delivery hollow needles (provided on rear sides of the respective cartridge holders) and ink delivery tubes (connected to the respective ink delivery hollow needles). With the image reader 4 being placed in its open position by pivoting the image reader 4 in the upward direction, i.e., in a direction toward a sheet supply tray 16 of the automatic sheet feeder 3, it is possible to carry out various maintenance procedures, as needed, such as replacement of the ink cartridge 7 and removal of paper sheet P jammed in the sheet feed path.

The multifunction device 1 further has an operator's control panel 9 disposed on an upper surface of its portion which is located on a front side of the image reader 4. The control panel 9 is equipped with a liquid-crystal display and various keys such as ten digit keys and function keys. It is noted that the above-described liquid-crystal display and keys are not shown in FIGS. 1, 5 and 6 in which the liquid-crystal display and keys are removed from the device 1.

The head unit 11 is arranged to be reciprocatable along a guide rod 12 which extends in a direction perpendicular to a feed direction (indicated by arrow A) in which the paper sheet P is to be fed by the sheet feeder 3. When the sheet P is passing through a platen 13, the head unit 11 is activated to eject the inks toward a top surface of the sheet P, so as to form or record a desired image on the surface of the sheet P. After the formation of the image thereon, the sheet P is further fed by a drive roller 14 and driven roller which are opposed to each other and located on a downstream side of the platen 13, so as to be eventually received by the sheet exit tray 10.

Figure 2:
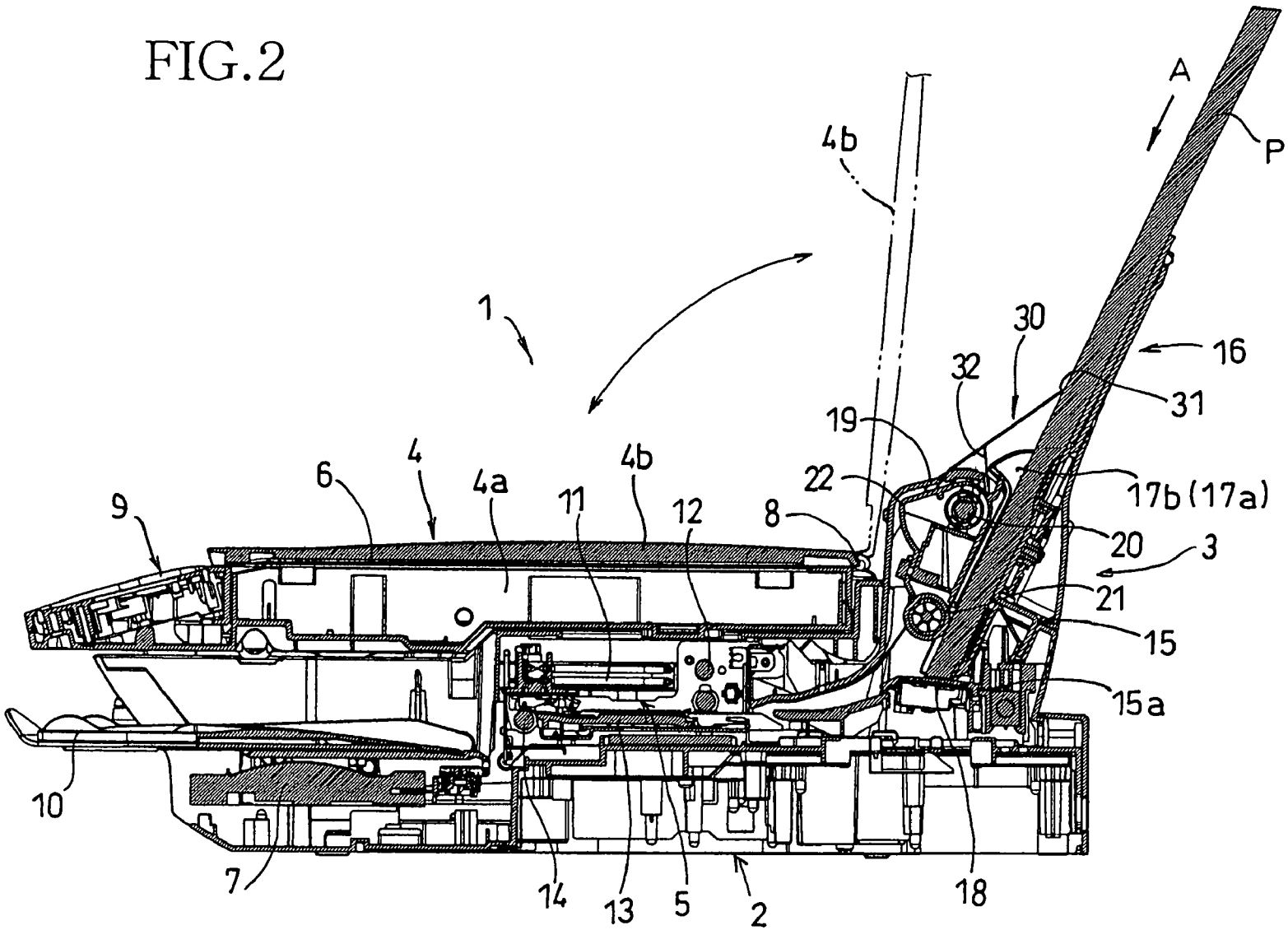
FIG. 2 is a cross sectional view taken along line 2-2 in FIG. 1.

As shown in FIG. 2, the sheet feeder 3 includes a sheet accommodator in the form of the above-described sheet supply tray 16 made of synthetic resin and capable of accommodating a plurality of paper sheets P thereon. The sheet supply tray 16 has an upper or front surface on which the sheets P are to be piled and along which the sheets P are to be fed in the feed direction A. The sheet supply tray 16 is supported by a support frame 15 which is also made of synthetic resin and which is fixed to a rear end portion of an upper surface of the casing body 2. On the front surface of the sheet supply tray 16 which is supported by the support frame 15 so as to be rearwardly slanted, there are disposed a pair of movable guide plates 17*a*, 17*b* which are also made of synthetic resin. The pair of guide plates 17*a*, 17*b* are connected to respective horizontally extending racks (not shown) which are disposed on a lower or rear surface of the sheet supply tray 16. The racks are held in engagement with a pinion (not shown) which is also disposed on the rear surface of the sheet supply tray 16, so that the pair of guide plates 17*a*, 17*b* are movable in a width direction of the sheet supply tray 16, symmetrically to each other with respect to a widthwise center of the sheet supply tray 16. That is, the pair of guide plates 17*a*, 17*b* can be moved toward or away from each other, so as to adjust a distance therebetween to a width of the paper sheets P piled on the front surface of the sheet supply tray 16. Each of the paper sheets P are guided at its widthwise opposite ends by guide surfaces of the respective guide plates 17*a*, 17*b*, and are positioned in the widthwise center of the sheet supply tray 16. It is noted that each of the guide plates 17*a*, 17*b* serves also as a clearance defining member, as described below.

In a lower portion 15*a* of the support frame 15, a plurality of separate plates 18 are provided to project in the feed direction. The separate plates 18 support lower or forward ends of the paper sheets P piled on the sheet supply tray 16, and separate an outermost or uppermost one of the piled sheets P from the other sheets, so as to guide the sheets P one after another, toward an image formation portion of the device 1 (see FIG. 2). On an upper surface of each separate plate 18, a separate portion having a high coefficient of friction is provided to be brought into contact with the lower or forward end of a widthwise central portion of each sheet P, so as to separate the uppermost sheet P.

The sheet feeder 3 further includes a front cover unit 19 which is made of synthetic resin and covers at least a downstream end portion of the front surface of the sheet supply tray 16. The front cover unit 19 has a rear end which is positioned relative to the sheet supply tray 16 such that a gap having a predetermined dimension W1 is defined between the rear end of the front cover unit 19 and the front surface of the sheet supply tray 16 (see FIG. 3). The thus defined gap serves an introduction opening 25 through which the piled sheets P are to be introduced along the front surface of the sheet supply tray 16 into an inside of the sheet feeder 3. Within the front cover unit 19, a transmission shaft 20 is freely rotatably fixed in a position that is distant from the upper surfaces of the separate plates 18 by a predetermined vertical distance. On an axially intermediate portion of the transmission shaft 20 (i.e., an intermediate portion of the transmission shaft 20 as viewed in the width direction of the paper sheet P), a casing-like arm 22 carrying a sheet supply roller 21 as a sheet supplier is mounted so as to be only pivotable. The arm 22 is biased by a torsion coil spring engaged with the transmission shaft 20, in such a direction that causes the sheet supply roller 21 (carried by the arm 22) to be pressed onto the top surface of an uppermost one of the paper sheets P piled on the sheet supply tray 16. The transmission shaft 20 is rotated in a predetermined direction by a drive force transmitted from a drive motor (not shown) which is disposed outside the front cover unit 19, via a gear train which is disposed inside the front cover unit 19. It is noted that the casing-like arm 22 is accommodated in a front protrusion portion 19*a* which protrudes forwardly from a widthwise central part of a main body portion of the front cover unit 19.

The sheet feeder 3 is equipped with a dust remover 30 for restraining dust (collecting on the paper sheets P piled on the sheet supply tray 16) from being carried by the paper sheets P toward the image formation portion of the device 1 via the introduction opening 25.

The dust remover 30, which is constructed according to the first embodiment of the invention, as shown in FIGS. 1-5, is provided by a flat resin plate made of polyimide, polypropylene, polyethylene terephthalate or other resin material having a certain degree of flexibility or elasticity. The flat resin plate is preferably transparent and has a thickness ranging from 0.5 mm to 2 mm, although the thickness is not limited to such a range. Where the dust remover 30 is provided by a transparent plate, the inside of the sheet feeder 3 can be seen through the opening 25 even while the opening 25 being covered by the dust remover 30.

The dust remover 30, provided by the flat plate, includes a generally rectangular main body portion 30*a* having a width H1 (as measured in a sheet-width direction which is parallel with the surface of the sheet supply tray 16 and which is perpendicular to the feed direction A) which is larger than a width H2 of the paper sheet P and which is substantially equal to or slightly larger than a width H3 of the opening 25 (as measured in the sheet-width direction). In the present embodiment, since the sheet feeder 3 is designed to accept the paper sheets P of size of A4 or smaller than A4, the width H1 of the main body portion 30*a* of the dust remover 30 is 240 mm. The main body portion 30*a* of the dust remover 30 has a contact end portion 31 at which the dust remover 30 is to be held in contact with a contacted portion of the top surface of the uppermost one of the sheets P piled on the sheet supply tray 16. With the contact end portion 31 of the dust remover 30 being held in contact with the contacted portion of the sheet surface, a portion of the sheet surface that is located on a forward side of the contacted portion is covered by the dust remover 30.

The contact end portion 31 has an extreme end extending straight in the above-described sheet-width direction and having a length which is substantially equal to the above-described width H1. The dust remover 30 has opposite end portions opposite to each other in its first direction that is perpendicular to the sheet-width direction. One of the opposite end portions provides the contact end portion 31, while the other of the opposite end portions provides a pair of inclined portions 32 which are integrally formed with the main body portion 30*a* and which serve as introduced portion introducible through the introduction opening 25 into the inside of the sheet feeder 3.

The pair of inclined portions 32 are formed by inclining respective widthwise opposite end parts of the above-described other end portion (which parts are opposite to each other in a second direction of the dust remover 30 that is perpendicular to the above-described first direction), by a predetermined inclining angle (180°-θ1), so that the inclined portions 32 are inclined with respect to the non-inclined main body portion 30*a* by a first angle θ1 that is supplement of the predetermined inclining angle (180°-θ1). The widthwise opposite end parts, which provide the pair of inclined portions 32, are defined at their respective widthwise inner ends by respective slits 33 which are formed in the above-described other end portion to extend over a predetermined distance in the above-described first direction (see FIGS. 1 and 4). Therefore, in the present first embodiment, since the introduced portions of the dust remover 30 are provided by the inclined portions 32 which can be easily formed by simply inclining the above-described widthwise opposite end parts with respect to the main body portion 30*a*, the dust remover 30 can be made compact in size with an easy manufacturing process at a low cost.

The front cover unit 19 has a rear wall 19*b* which extends vertically and is opposed to the front surface of the sheet supply tray 16. This rear wall 19*b* cooperates with a front end 34 of each of the guide plates 17*a*, 17*b* to define a clearance in which the inclined portions 32 of the dust remover 30 are introduced (see FIG. 3).

A distance H4 between outer ends of the respective inclined portions 32 of the dust remover 30 as measured in the above-described second direction is adapted to be equal to or slightly smaller than the above-described width H3 of the opening 25 (H4≦H3), so that the dust remover 30 (which is introduced at its inclined portions 32 in the above-described clearance) can be prevented or restrained from being displaced relative to the sheet supply tray 16 in the above-described sheet-width direction or second direction. It is preferable that a difference between the values H3, H4 is not larger than about 2 mm (H3-H4≦about 2 mm). In the present embodiment, the distance H4 is substantially equal to the width H1 of the main body portion 30*a* of the dust remover 30 (H1≈H4). It is noted that the introduction opening 25 may be formed with a recess definer which defines a plurality of recess each having substantially the same width as a corresponding one of the inclined portions 32, so that the inclined portions 32 can be introduced in the respective recesses, for thereby restraining the dust remover 30 from being displaced in the sheet-width direction.

The dust remover 30 is removed from the device 1, prior to setting of the paper sheets P on the front surface of the sheet supply tray 16, i.e., in an initial position of the sheet feed path. With the dust remover 30 being separated from the device 1, a desired number of paper sheets P are introduced through the introduction opening 25 along the front surface of the sheet supply tray 16 so as to be positioned in the initial position. Being positioned in the initial position, the paper sheets P piled on the front surface of the sheet supply tray 16 are held in contact at their lower or front ends with the separate plates 18. In this instance, the paper sheets P are restrained from being displaced relative to the sheet supply tray 16 in the sheet-width direction, owing to the pair of guide plates 17*a*, 17*b* spaced apart from each other by the distance that is adjusted to the width of the paper sheets P.

After the setting of the paper sheets P in the initial position, the dust remover 30 is introduced at its inclined portions 32 into the introduction opening 25, more specifically, into the above-described clearance defined between the rear wall 19*b* of the front cover unit 19 and the front end 34 of each of the guide plates 17*a*, 17*b*. The contact end portion 31 of the dust remover 30 is then brought into contact at its straight extending extreme end with the top surface of an uppermost one of the piled paper sheets P (see FIG. 3), such that the extreme end extends in the sheet-width direction that is perpendicular to the feed direction (indicated by the arrow A). In this instance, the main body portion 30*a* of the dust remover 30 is held inclined with respect to an upper or rear end potion of the top surface of the uppermost paper sheet P by an obtuse angle θ2 (>90°).

Figure 5:
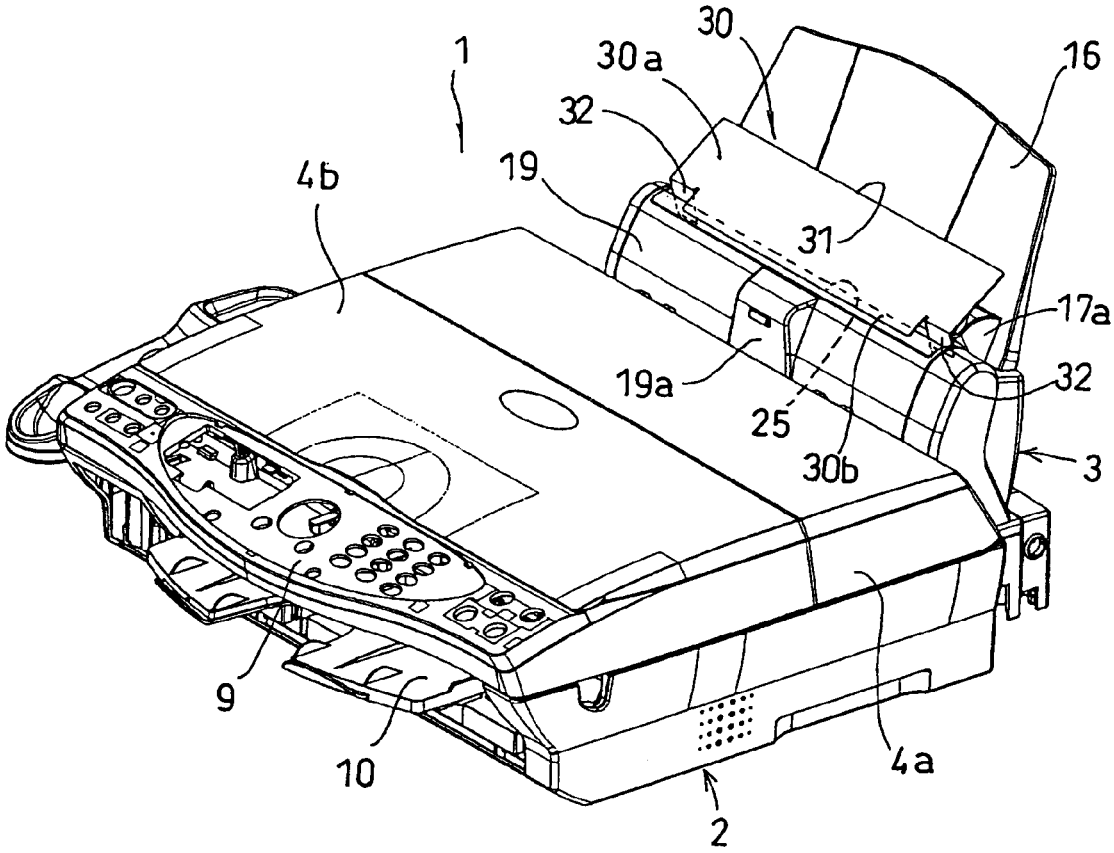
FIG. 5 is a perspective view showing a state in which the dust remover is held in contact with a sheet supply tray as a sheet accommodator in absence of sheets remaining on the sheet supply tray.

In the present embodiment, the dust remover 30 is simply introduced at its inclined portions 32 into the above-described clearance defined between the rear wall 19*b* of the front cover unit 19 and the front end 34 of each guide plate 17, which are spaced apart from each other by such a distance that allows pivot motion of the dust remover 30. This arrangement enables the dust remover 30 to be pivoted so as to be constantly held in contact at its contact end portion 31 with the top surface of the currently uppermost paper sheet P, owing to an own weight of the dust remover 30. With the contact end portion 31 of the dust remover 30 being held in contact with the top surface of the paper sheet P, the opening 25 is entirely covered by the dust remover 30 which is positioned right above the opening 25, thereby restraining dust from entering the inside of the sheet feeder 3 or inside of multifunction device 1, through the opening 25. Further, where the front surface of the sheet supply tray 16 is provided by a flat surface, the straight extending extreme end of the contact end portion 31 of the dust remover 30 and the flat front surface of the sheet supply tray 16 can be held in contact with each other without a gap therebetween, in absence of the paper sheets P remaining on the sheet supply tray 16, as shown in FIG. 5. Thus, the entrance of the foreign matter into the inside of the device 1 can be prevented irrespective of whether the paper sheets P remain on the sheet supply tray 16 or not. It is noted that two-dot chain line of FIG. 3 indicates an attitude of the dust remover 30 as held in contact with at the contact end portion 31 with the flat front surface of the sheet supply tray 16.

In the present embodiment, while the above-described widthwise opposite end parts of the above-described other end portion of the dust remover 30 are inclined to provide the pair of inclined portions 32, a widthwise intermediate part of the other end portion is not inclined to provide an extension portion 30*b*. This extension portion 30*b*, which is located between the pair of inclined portions 32, serves to cover a wide area of an outer surface of an upper wall 19*c* of the front cover unit 19, which surface is curved to be convexed upwardly. Owing to the extension portion 30*b* of the dust remover 30, it is possible to minimize dust from collecting on the upper wall 19*c*. Since collection of dust on the upper wall 19*c* is thus minimized, it is possible to minimize entrance of dust into the inside of the device 1 through the opening 25, which dust comes from the upper wall 19*c* via the rear wall 19*b*. The extension portion 30*b* cooperates with the inclined portions 32 to constitute a proximal end portion of the dust remover 30 at which the dust remover 30 is supported by the front cover unit 19 as a dust-remover supporter.

The dust remover 30 is supported by the front cover unit 19 such that its proximal end portion is positioned on a downstream side of its distal end portion (which serves as the contact end portion 31) as viewed in the feed direction A and such that its proximal end portion is positioned to be more distant from the front surface of the sheet supply tray 16 than its distal end portion, so that the main body portion 30*a* of the dust remover 30 is inclined with respect to the upper or rear end potion of the top surface of the uppermost paper sheet P by the obtuse angle θ2 (>90°). The thus supported dust remover 30 is pivotable about its proximal end portion by such an amount that permits its distal end portion to be constantly held in contact with the top surface of the uppermost sheet P irrespective of number of the sheets P remaining on the sheet supply tray 16.

In the present embodiment, the dust remover 30 is introduced at its inclined portions 32 in the above-described clearance which is defined between the rear wall 19*b* of the front cover unit 19 and the front end 34 of each guide plate 17, such that the inclined portions 32 are allowed to be moved or rocked within the clearance for allowing the pivot motion of the dust remover 30. Owing to allowance of the rocking motion of the inclined portions 32 within the clearance, the dust remover 30 is allowed to be displaced relative to the front surface of the sheet supply tray 16 or to the top surface of the uppermost paper sheet P.

Each of the inclined portions 32 is inclined with respect to the main body portion 30*a* by the first angle θ1, as described above. A relationship between the first angle θ1 and the above-described obtuse angle θ2 is represented by the following expression:

$$(\theta 2\text{-}90°)<\theta 1<\theta 2.$$

Figure 3:
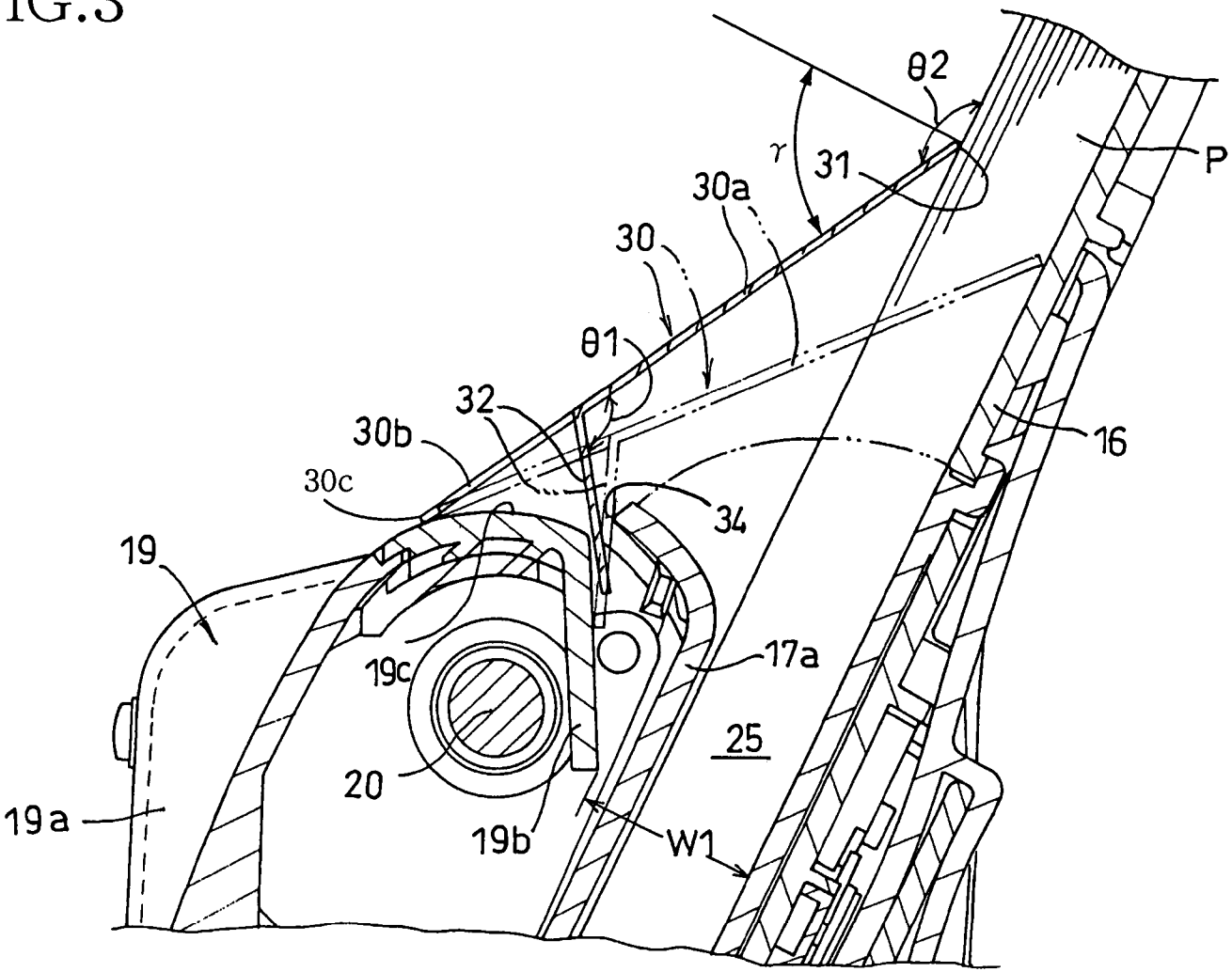
FIG. 3 is a cross sectional view taken along line 3-3 in FIG. 4 and showing disposition of the dust remover in the multifunction device of FIG. 1.
Figure 4:
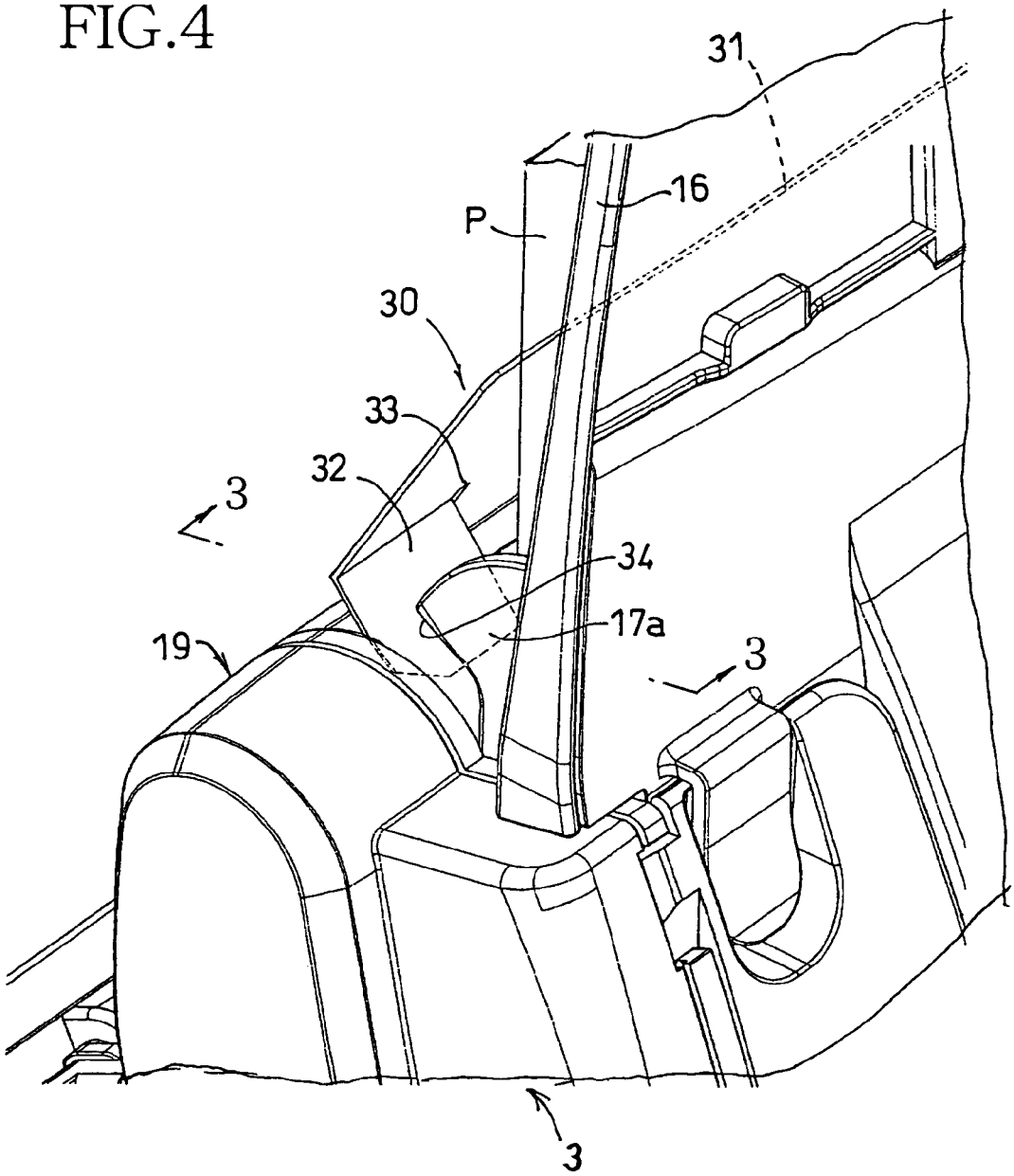
FIG. 4 is a perspective view showing the disposition of the dust remover in the multifunction device of FIG. 1.

Therefore, each inclined portion 32 extends from the main body portion 30*a* in such a direction that permits a distal end of the inclined portion 32 to be positioned on a downstream side of a proximal end of the inclined portion 32 as viewed in the feed direction A and permits the distal end of the inclined portion 32 to be positioned to be closer to the front surface of the sheet supply tray 16 than the proximal end of the inclined portion 32, as is apparent from FIG. 3.

Each inclined portion 32 is opposed to a first contact portion of the front cover unit 19 which portion is provided by an upper portion of an outer surface of the rear wall 19*b*, so as to be held in contact with the first contact portion of the front cover unit 19. Meanwhile, the extension portion 30*b* is held in contact at its end 30*c* with a second contact portion of the front cover unit 19 which portion is provided by an outer surface of the upper wall 19*c* and which is more remote from the front surface of the sheet supply tray 16 than the above-described first contact portion. The outer surface of the upper wall 19*c* is curved to be convexed in the upward direction, i.e., a direction away from a center of pivot motion of the dust remover 30, such that the end 30*c* of the extension portion 30*b* can be smoothly slid on the curved surface of the upper wall 19*c* when the dust remover 30 is pivoted. It is noted that the extension portion 30*b* cooperates with the main body portion 30*a* to constitute a main body of the dust remover 30. The main body of the dust remover 30 includes opposite end portions one of which is provided by the contact end portion 31, and a non-end portion which is located between the opposite end portions and from which the introduced or inclined portions 32 extend.

The first contact portion of the front cover unit 19 is opposed to each inclined portion 32 of the dust remover 30 as viewed both in a direction parallel with the front surface of the sheet supply tray 16 and in a direction perpendicular to the front surface of the sheet supply tray 16, so that the dust remover 30 can be supported at its inclined portions 32 by the first contact portion of the front cover unit 19, so as to be prevented from being displaced both in the feed direction A and in a direction away from the front surface of the sheet supply tray 16.

The first contact portion of the front cover unit 19 and the front end 34 of each guide plate 17 cooperate with each other to define the above-described clearance therebetween, and are spaced apart from each other by the distance that is larger than a thickness of each inclined portion 32 of the dust remover 30, so as to allow the pivot motion of the dust remover 30 which is received at its inclined portions 32 in the clearance.

If the cover member 4*b* of the image reader 4 is opened by an operator, as indicted by two-dot chain line in FIG. 2, with foreign matter or objects (e.g., rubber band, clip, staple, headband, tablet, pencil, trash or the like) being accidentally placed on the upper surface of the cover member 4*b*, the objects are thrown toward the top surface of the uppermost paper sheet P, or toward the front surface of the sheet supply tray 16 in absence of the paper sheets P remaining on the sheet supply tray 16. In this instance, the thrown objects tumble down the dust remover 30 and the front cover unit 19, and eventually fall onto a front side of the front cover unit 19, without entering the inside of the device 1 through the opening 25, since the opening 25 and the upper wall 19*c* of the front cover unit 19 are covered by the main body portion 30*a* and the extension portion 30*b* of the dust remover 30, respectively. That is, this arrangement is effective to avoid inconvenience in the event of an operator's careless operation, thereby increasing safety in the operation of the device 1.

In an image recording operation with the present multifunction device 1, the automatic sheet feeder 3 is first activated, in response to a command signal which is inputted through an external device such as a computer connected to the device 1, or which is inputted by an operator who presses a copier-function key (not shown) provided in the control panel 9. With the activation of the sheet feeder 3, the uppermost paper sheet P is fed in the feed direction. The inkjet printer 5 is then activated when the sheet P is passing through the platen 13, to form a desired image on the top surface of the sheet P, with ejection of selected color inks toward the sheet P. The sheet P having the image formed on its top surface is further fed so as to be received by the sheet exit tray 10. In the operation, when the uppermost one of the sheets P piled on the sheet supply tray 16 is moved from the above-described initial position in the feed direction, the top surface of the uppermost sheet P is raked by the contact end portion 31 of the dust remover 30 which is held in sliding contact with the top surface of the sheet P. Since the main body portion 30*a* of the dust remover 30 is held inclined with respect to the upper or rear end potion of the top surface of the sheet P by the obtuse angle θ2, namely, since the main body portion 30*a* of the dust remover 30 cooperates with a plane perpendicular to the top surface of the sheet P (or perpendicular to the feed direction) to define a positive rake angle γ (>0°), any dust sticking to or collecting on the top surface of the sheet P can be effectively removed by the contact end portion 31 of the dust remover 30. The removed dust is received onto the main body portion 30*a* of the dust remover 30, and then tumbles down the main body portion 30*a* which is inclined with respect to a horizontal direction. The removed dust eventually drops onto the front side of the front cover unit 19, without entering the inside of the device 1 through the opening 25.

As the number of the sheets P remaining on the sheet supply tray 16 is reduced with consume of the sheets P, a distance between the top surface of the currently uppermost sheet P and the front surface of the sheet supply tray 16 is reduced. Even with the reduction in this distance, the dust remover 30 can be held in constant contact at its contact end portion 31 with the top surface of the currently uppermost sheet P, with an increase in the degree of rearward inclination of the main body portion 30*a* with respect to the front surface of the sheet supply tray 16, which increase is obtained by the pivot motion of the dust remover 30 caused owing to its own weight.

In the present embodiment, the flat resin plate providing the dust remover 30 has the thickness of about 0.5-2.0 mm, while the above-described angle θ2 (by which the main body portion 30*a* of the dust remover 30 is inclined with respect to the upper or rear end portion of the uppermost sheet P) is adapted to range from about 140° (in absence of the sheets P piled on the tray 16) to about 150° (in presence of permissible maximum numbers of the sheets P piled on the tray 16). The term "dust", which is repeatedly used in the present specification, should be interpreted to mean any foreign matter having such a size that permits it to be removed by the dust remover 30 which is constructed or arranged as described above. Described specifically, the term "dust" should be interpreted to include particle, grain, dirt, powder, cotton dirt, paper powder and any other foreign matter which could accidentally stick to the sheet P. It is noted that the above-described angle θ2 is not particularly limited to the above-described range, but may be changed, as needed, depending upon various factors such as the degree of inclination of the sheet supply tray 16 and the size of the dust remover 30.

Further, in the present embodiment, the dust remover 30 can be removed from the opening definer (which is constituted by the front cover unit 19 and the guide plates 17*a*, 17*b*) without using any tool. Further, in this instance, it is not necessary to deform the dust remover 30 and the opening definer. Since the dust remover 30 is thus easily detachably incorporated in the automatic sheet feeder 3, the multifunction device 1 can be packed in a carton, with the detached dust remover 30 being accommodated in a flat space within the carton.

Figure 12A:
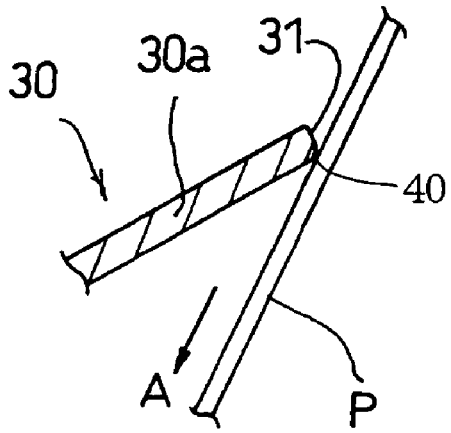
FIG. 12A is a side view showing in cross section of a contact end portion of the dust remover in an arrangement in which the contact end portion is chamfered at its surface.
Figure 12B:
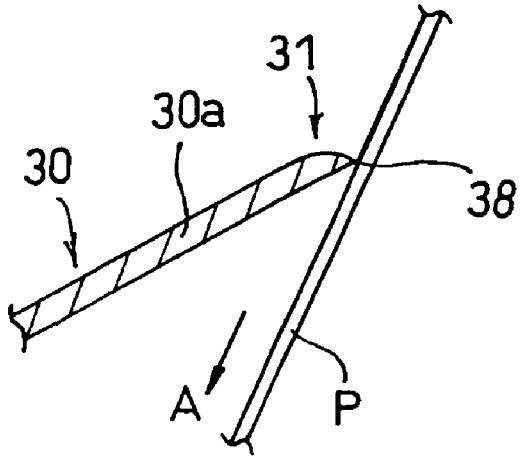
FIG. 12B is a side view showing in cross section of the contact end portion of the dust remover in an arrangement in which the contact end portion is sharpened to be defined by a ridge.

FIGS. 12A and 12B illustrate respective examples of shape of the contact end portion 31 of the dust remover 30. In the example of FIG. 12A, the contact end portion 31 has a rounded surface 40 which is formed by chamfering along an intersection of an extreme end surface and one of two major surfaces (that are opposite to each other in a thickness direction of the dust remover 30) of the dust remover 30, so that the contact end portion 31 can be held in contact at its rounded or chamfered surface 40 with the top surface of the sheet P, namely, so that the contact end portion 31 can be held in contact at its increased area with the surface of the sheet P, thereby making it possible to rake or remove dust from the top surface of the sheet P, without a risk of scratch on the surface of the sheet P, even where the used sheet P is provided by a high-quality paper sheet such as a glossy paper sheet. In the example of FIG. 12B, the contact end portion 31 is sharpened to be defined by a ridge 38, so that the contact end portion 31 of the dust remover 30 can be held in contact at the ridge 38 with the top surface of the sheet P, thereby making it possible to easily rake or remove dust from the surface of the sheet P, even where the used sheet P is provided by a standard paper sheet having a somewhat rough surface.

Figure 6:
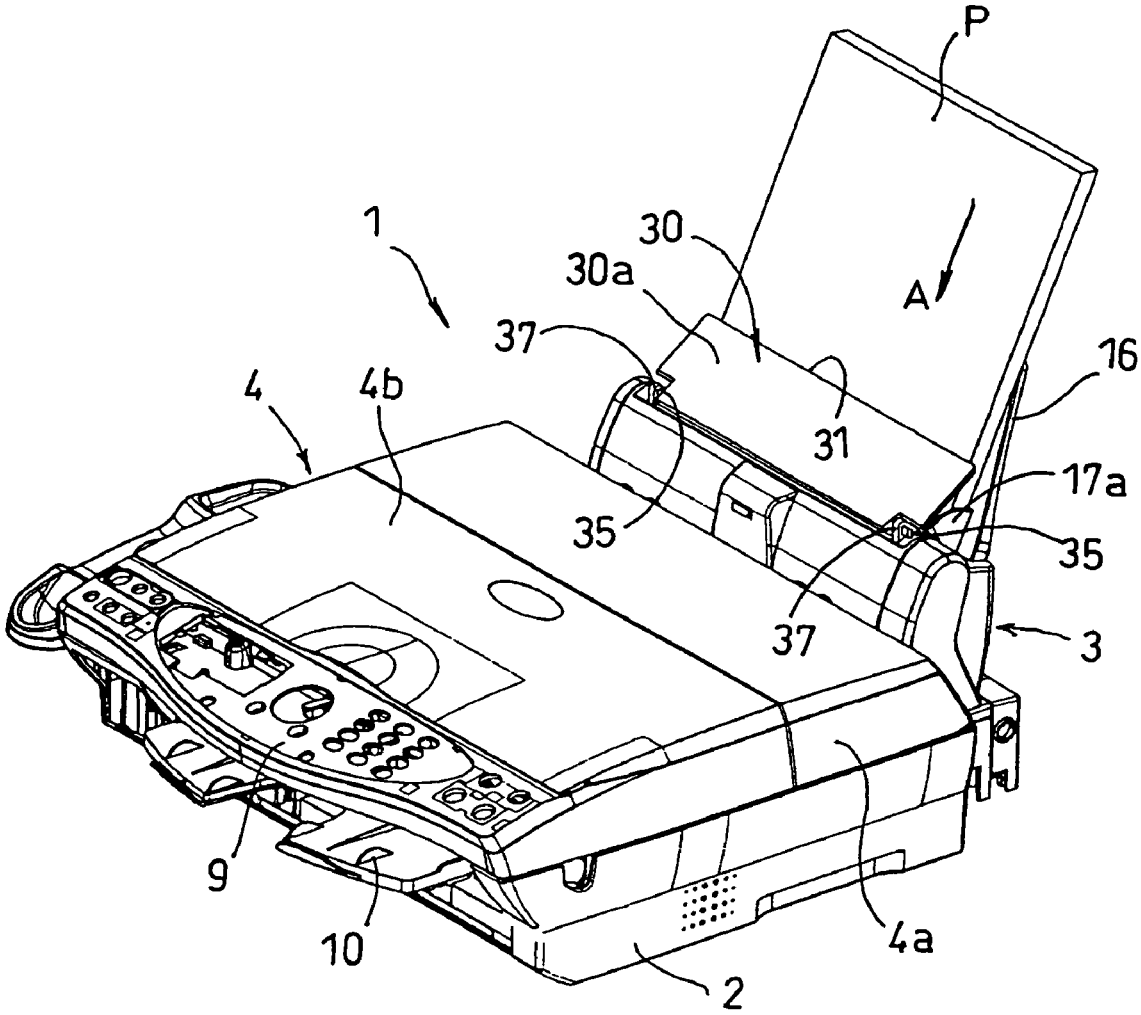
FIG. 6 is a perspective view of a multifunction device incorporating a dust remover which is constructed according to a second embodiment of the invention.
Figure 7:
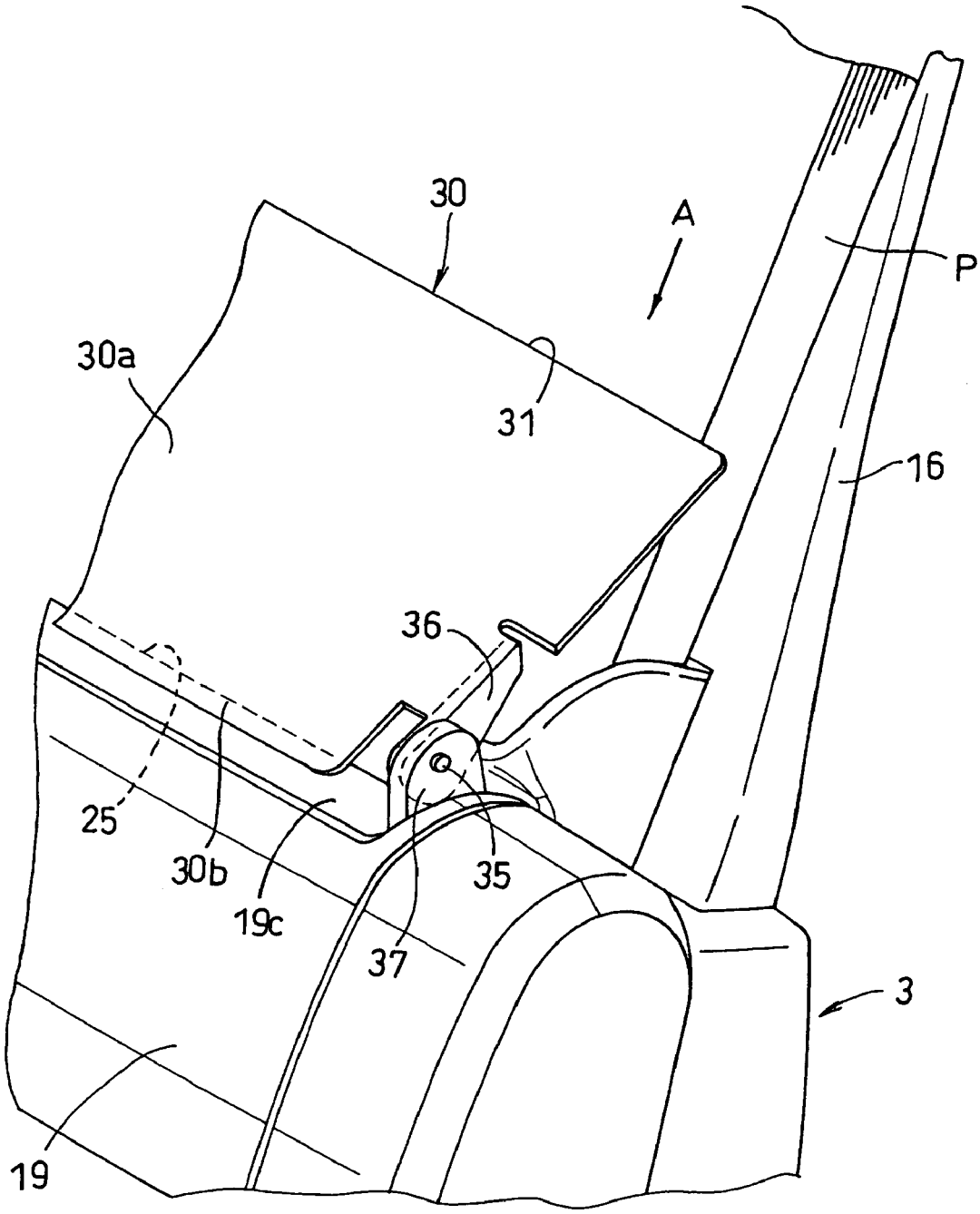
FIG. 7 is a perspective view showing a part of the dust remover of the second embodiment in enlargement.
Figure 8:
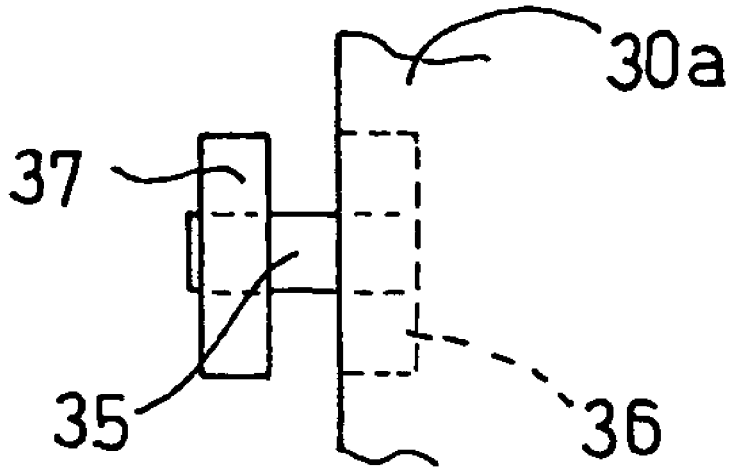
FIG. 8 is a fragmentary view showing a part of the dust remover of the second embodiment at which the dust remover is pivotably supported by a bracket.

Referring next to FIGS. 6-8, there will be described a second embodiment of the invention. In the second embodiment, the main body portion 30*a* of the dust remover 30 may be made of the same material as in the above-described first embodiment. Further, the straight extreme end of the contact end portion 31 of the dust remover 30 may be given the same length as in the first embodiment. The dust remover 30 has a pair of flange portions 36 formed in the respective widthwise opposite end portions (which are opposite to each other in the above-described second direction). The flange portions 36 are provided with pivot shafts 35 which extend in the second direction, such that the pivot shafts 35 are located in the proximal end portion of the dust remover 36. The automatic feeder 3 has a pair of brackets 37 which are located in the vicinity of the opening 25, for example, in the opposite end portions of the opening 25 as viewed in the sheet-width direction. The dust remover 30 is held at the pivot shafts 35 by the brackets 37 which have respective through-holes receiving therein the respective pivot shafts 35, so that the dust remover 30 is pivotably attached, at its flange portion 36 as an attached portion, to the front cover unit 19 through the brackets 37. Since the dust remover 30 is pivotable about its pivot shafts 35, the dust remover 30 can be constantly held in contact at its distal end portion, i.e., at its contact end portion 31 with the top surface of an uppermost one of the paper sheets P piled on the sheet supply tray 16, owing to the own weight of the dust remover 30 which is inclined rearwardly toward the front surface of the sheet supply tray 16 which is also inclined rearwardly.

This second embodiment provides the same technical advantages as the above-described first embodiment, and additional advantages. For example, in replenishment of the tray 16 with new paper sheets P, the dust remover 30 is simply pivoted so as to move the contact end portion 31 in a direction away from the tray 16, and then pivoted in the opposite direction so as to move the contact end portion 31 toward the tray 16 after the new paper sheets P have been set on the tray 16. Further, since the dust remover 30 is not easily removed from the brackets 37, there is little risk of missing of the dust remover 30.

In the second embodiment, the pivot shaft 35 is provided in each of the flange portions 36 while the through-hole is formed in each of the brackets 37. However, the pivot shaft 35 may be provided in each bracket 37 while the through-hole may be formed in each flange portion 36. In either of these cases, the pivot shafts 35 can be introduced into the respective through-holes, by elastically bending the main body portion 30*a* of the dust remover 30 having the certain degree of elasticity.

Figure 9:
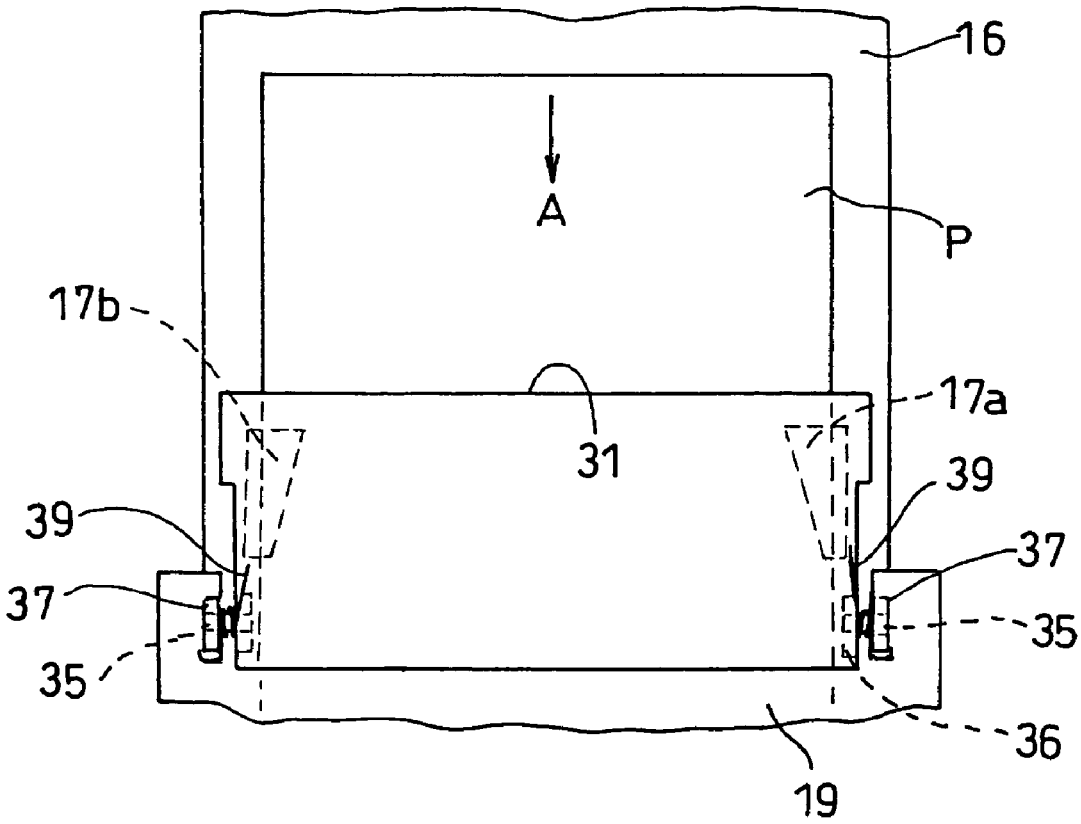
FIG. 9 is a plan view showing a modified arrangement of the second embodiment in which the dust remover is provided with a torsion coil spring as a biaser.
Figure 10:
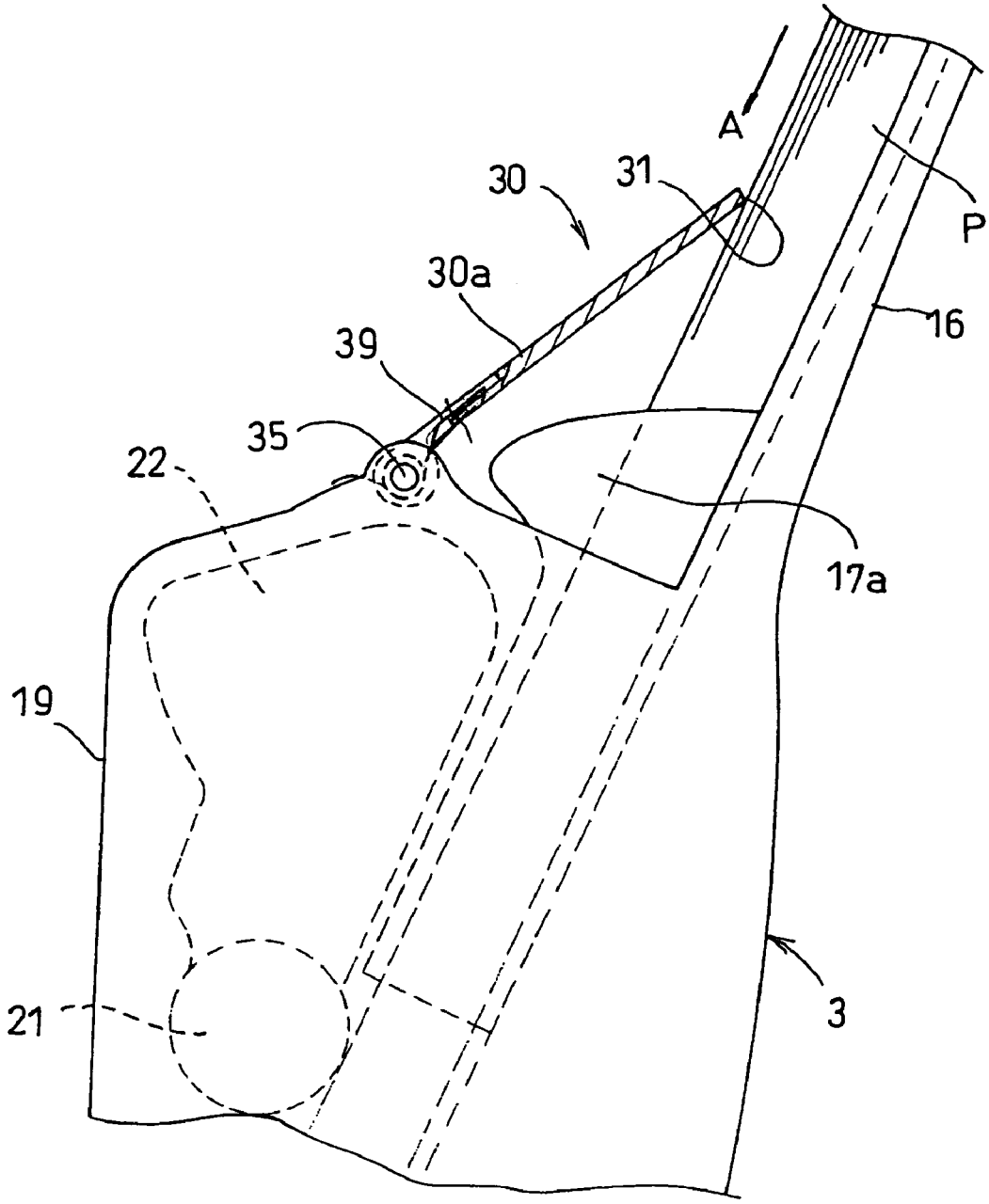
FIG. 10 is a side view showing the arrangement of FIG. 9.

FIGS. 9 and 10 show a modified arrangement of the second embodiment in which a biaser is provided to bias the contact end portion 31 of the dust remover 30 toward the front surface of the sheet supply tray 16. In this modified arrangement, a torsion coil spring 39 as the biaser is mounted on a circumferential surface of each of the pivot shafts 35, and is fixedly engaged at its opposite end portions with the corresponding bracket 37 and a portion (e.g., the main body portion 30*a*) of the dust remover 30, respectively. Owing to the coil spring 39 as the biaser, the contact end portion 31 of the dust remover 30 can be held in contact with the top surface of the uppermost sheet P with an increased contact force leading to enhancement in capacity of removing dust from the surface of the sheet P.

Figure 11:
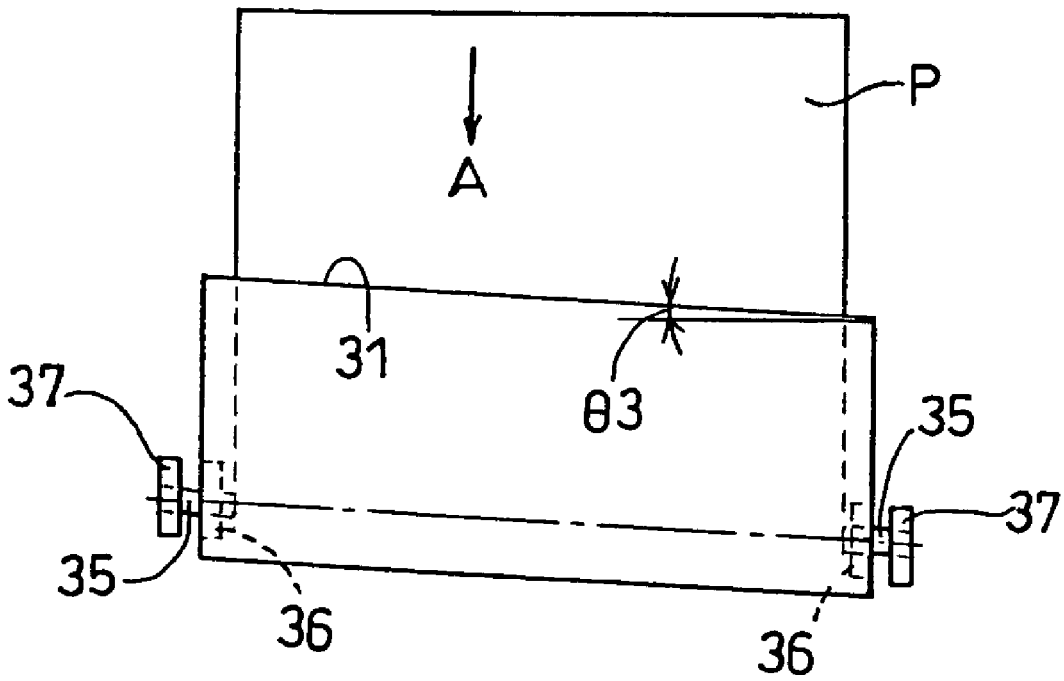
FIG. 11 is a plan view showing an another modified arrangement of the second embodiment in which the dust remover is set to be inclined with respect to a paper sheet.

FIG. 11 shows an another modified arrangement of the second embodiment in which the extreme end of the contact end portion 31 is adapted to extend not in a direction perpendicular to the feed direction A of the paper sheet P but in a direction that is slightly inclined with respect to the direction perpendicular to the feed direction A by an angle θ3 of about 1-5°. For allowing the inclined posture of the extreme end of the contact end portion 31, an axis of each of the pivot shafts 35 is also made inclined with respect to the direction perpendicular to the feed direction A, and is made parallel with the direction in which the extreme end of the contact end portion 31 extends. In this modified arrangement, the dust remover 30 can be constantly held in contact at its extreme end of the contact end portion 31 with the top surface of the uppermost paper sheet P over an entire width of the sheet P, irrespective of number of the sheets P remaining in the sheet supply tray 16, like in the above-described embodiments and modified arrangement. Further, in this modified arrangement, as the sheet P is fed in the feed direction, dust removed or raked by the extreme end of the contact end portion 31 is likely to be displaced along the extreme end in a direction away from an upstream-side portion of the extreme end toward a downstream-side portion of the extreme end, namely, in a rightward direction as seen in FIG. 11. The dust displaced toward the downstream-side portion of the extreme end of the contact end portion 31 is then likely to drop from a side margin of the sheet P or the dust remover 30. Thus, the removed dust tends to be collected in a particular position, facilitating an efficient cleaning.

While the preferred embodiments of the invention have been described above, it is to be understood that the invention is not limited to the details of the illustrated embodiments, but may be otherwise embodied.

In the illustrated embodiments of the invention described above, the pair of guide plate 17*a*, 17*b* are both movable in the width direction of the sheet supply tray 16. However, one of the guide plates may be held stationary, so that a distance therebetween is changeable by movement of the other of the guide plates relative to the stationary guide plate.

In the illustrated embodiments described above, the sheet accommodator is provided by the sheet supply tray in which the sheets P are piled thereon while taking rearwardly inclined postures. However, the principle of the invention is equally applicable to an arrangement in which the sheet accommodator is arranged such that the sheets P are piled therein while taking horizontal postures. Further, in the illustrated embodiments, the feeding device and the dust remover constructed according to the invention are incorporated in the multifunction device as the data processor apparatus. However, they may be incorporated in other kind of apparatus such as a standard printer.

What is claimed is:

1. A feeding device capable of feeding sheets one after another in a feed direction, comprising:

a sheet accommodator capable of accommodating the sheets piled therein and having a surface on which the sheets are to be piled and along which the sheets are to be fed in the feed direction; and a dust remover including a contact portion, which is constantly held in contact with a surface of an uppermost one of the sheets piled in the sheet accommodator, irrespective of the number of sheets remaining in the sheet accommodator, so as to remove dust from the surface of the uppermost sheet that is fed from the sheet accommodator in the feed direction, wherein the dust remover is supported by a dust remover supporter so as to be constantly held in contact with the surface of the uppermost one of the sheets, wherein the contact portion of the dust remover is provided by an end portion of the dust remover, such that the end portion of the dust remover rakes the dust from the surface of the uppermost sheet as the uppermost sheet is fed in the feed direction that is parallel with the surface of the uppermost sheet, wherein the end portion has an extreme end extending straight over an entire width of the sheets in a sheet-width direction, the sheet-width direction being parallel with the surface of the sheet accommodator and perpendicular to the feed direction, wherein the dust remover is held inclined with respect to a rear end portion of the surface of the uppermost sheet as viewed in the feed direction such that the end portion of the dust remover cooperates with a plane perpendicular to the surface of the uppermost sheet to define a positive rake angle.

2. The feeding device according to claim 1, wherein the dust remover is tool-free removable from at least one component which cooperates with the dust remover to compose the feeding device.

3. The feeding device according to claim 2, wherein the dust remover is removable from the at least one component, with substantially no deformation of the dust remover and the at least one component.

4. The feeding device according to claim 1, wherein the contact portion of the dust remover is held in contact with a contacted portion of the surface of the uppermost sheet, and wherein the dust remover is positioned relative to the sheet accommodator in such a position that permits the dust remover to cover at least a portion of the surface of the uppermost sheet that is located on a forward side of the contacted portion as viewed in the feed direction.

5. The feeding device according to claim 1, wherein the dust remover is provided by a plate member having (i) a distal end portion, the distal end portion providing the contact portion and being the end portion; and (ii) a proximal end portion at which the plate member is supported by the dust-remover supporter such that the proximal end portion is positioned on a downstream side of the distal end portion as viewed in the feed direction and such that the proximal end portion is positioned to be more distant from the surface of the sheet accommodator than the distal end portion.

6. The feeding device according to claim 5, wherein the plate member as the dust remover is pivotably supported by the dust-remover supporter such that the plate member is pivotable about the proximal end portion by such an amount that permits the distal end portion to be constantly held in contact with the surface of the uppermost sheet irrespective of number of the sheets remaining in the sheet accommodator.

7. The feeding device according to claim 6, wherein the sheet accommodator is provided by a sheet supply tray which has a surface on which the sheets are to be piled, and wherein the dust-remover supporter is provided by a cover unit which covers at least a downstream end portion of the surface of the sheet supply tray as viewed in the feed direction.

8. The feeding device according to claim 1, further comprising an opening definer defining an introduction opening through which the sheets are to be introduced into an inside of the feeding device, wherein the dust remover includes a portion which covers the introduction opening.

9. The feeding device according to claim 8, wherein the dust remover includes an attached portion which is attached to the opening definer.

10. The feeding device according to claim 8, wherein the sheet accommodator has a surface on which the sheets are to be piled and along which the sheets are to be fed in the feed direction, wherein the opening definer is constituted by the sheet accommodator and a cover unit which covers at least a downstream end portion of the surface of the sheet accommodator as viewed in the feed direction, such that the introduction opening is defined between the sheet accommodator and the cover unit, and wherein the dust remover further includes a portion which covers at least a portion of the cover unit.

11. The feeding device according to claim 8, wherein the sheet accommodator is provided by a sheet supply tray which has a surface on which the sheets are to be piled, the feeding device further comprising:

a pair of guide members which are disposed on the surface of the sheet supply tray and which have respective guide surfaces extending in the feed direction, wherein at least one of the pair of guide members is movable in a sheet-width direction which is parallel with the surface of the sheet supply tray and which is perpendicular to the feed direction, so that a distance between the guide surfaces of the pair of guide members can be adjusted to a width of the sheets, and wherein the pair of guide members are disposed between the dust remover and the sheet supply tray.

12. The feeding device according to claim 1, further comprising a cover unit which covers at least a downstream end portion of the surface of the sheet accommodator as viewed in the feed direction, wherein the cover unit and the surface of the sheet accommodator cooperate with each other to define an introduction opening therebetween through which the sheets can be introduced into an inside of the cover unit, and wherein the extreme end of the end portion of the dust remover extends over a distance that is not shorter than a dimension of the introduction opening as measured in the sheet-width direction.

13. The feeding device according to claim 1, wherein the surface of the sheet accommodator is flat, so that the extreme end of the end portion of the dust remover and the surface of the sheet accommodator can be held in contact without a gap therebetween, in absence of the sheets remaining in the sheet accommodator.

14. The feeding device according to claim 1, wherein the surface of the sheet accommodator is inclined with respect to a vertical direction, so that the contact portion of the dust remover is biased toward the surface of the sheet accommodator, owing to an own weight of the dust remover.

15. The feeding device according to claim 1, further comprising a biaser which biases the contact portion of the dust remover toward the surface of the sheet accommodator.

16. A data processing apparatus comprising:

the feeding device which is defined in claim 1; and at least one of an image reader and a printer head, to which the sheets are fed to be subjected to respective operations achieved by the at least one of the image reader and the printer head.

17. The data processing apparatus according to claim 16, further comprising a pivotable cover member which covers a horizontal surface of the apparatus, wherein the pivotable cover member is pivotable independently of the feeding device, about one of opposite end portions thereof that is closer to the feeding device than the other of the opposite end portions, so as to be pivotable between a horizontal position and a vertical position thereof for covering and exposing the horizontal surface, respectively, wherein the feeding device has an opening definer defining an introduction opening through which the sheets are to be introduced into an inside of the feeding device, and wherein the dust remover includes a portion which covers the introduction opening.

18. The feeding device according to claim 1, wherein the dust remover extends above the dust remover supporter, and wherein the end portion of the dust remover has an upper extreme end, the upper end being the extreme end and being constantly held in contact with the surface of the uppermost sheet.

19. The feeding device according to claim 1, wherein the contact portion of the dust remover is held in contact with the uppermost one of the sheets that is fed in the feed direction earlier than the other of the sheets.

20. A feeding device capable of feeding sheets one after another in a feed direction, comprising:

a sheet accommodator capable of accommodating the sheets piled therein; and a dust remover including a contact portion, which is held in contact with a surface of an uppermost one of the sheets piled in the sheet accommodator, irrespective of the number of sheets remaining in the sheet accommodator, so as to remove dust from the surface of the uppermost sheet that is fed from the sheet accommodator in the feed direction, wherein the sheet accommodator has a surface on which the sheets are to be piled and along which the sheets are to be fed in the feed direction, wherein the dust remover is provided by a plate member having (i) a distal end portion as the end portion providing the contact portion and (ii) a proximal end portion at which the plate member is supported by the dust-remover supporter such that the proximal end portion is positioned on a downstream side of the distal end portion as viewed in the feed direction and such that the proximal end portion is positioned to be more distant from the surface of the sheet accommodator than the distal end portion, wherein the plate member as the dust remover is pivotably supported by the dust-remover supporter such that the plate member is pivotable about the proximal end portion by such an amount that permits the distal end portion to be constantly held in contact with the surface of the uppermost sheet irrespective of number of the sheets remaining in the sheet accommodator, wherein the plate member as the dust remover includes a main body having opposite end portions one of which is provided by the distal end portion serving as the contact portion, wherein the plate member further includes an inclined portion serving as the proximal end portion which is inclined with respect to the main body and which is received in a receiving space defined between the dust-remover supporter and the sheet accommodator, wherein the inclined portion of the plate member extends from a non-end portion of the main body in such a direction that permits a distal end of the inclined portion to be positioned on a downstream side of a proximal end of the inclined portion as viewed in the feed direction and permits the distal end of the inclined portion to be positioned to be closer to the surface of the sheet accommodator than the proximal end of the inclined portion, wherein the dust-remover supporter includes a first contact portion and a second contact portion which are positioned on one of opposite sides of the inclined portion of the plate member that is remote from the surface of the sheet accommodator, wherein the first contact portion is opposed to the inclined portion of the plate member, and is held in contact with the inclined portion of the plate member, and wherein the second contact portion is more remote from the surface of the sheet accommodator than the first contact portion, and is held in contact with the other of the opposite end portions of the main body of the plate member.

21. The feeding device according to claim 20, wherein the second contact portion is provided by a curved surface which is curved such that the curved surface is convexed in a direction away from a center of pivot motion of the plate member as the dust remover.

22. The feeding device according to claim 20 wherein the first contact portion of the dust-remover supporter is opposed to the inclined portion of the plate member as viewed both in a direction parallel with the surface of the sheet accommodator and in a direction perpendicular to the surface of the sheet accommodator, so that the plate member can be supported at the inclined portion thereof by the first contact portion of the dust-remover supporter, so as to be prevented from being displaced both in the feed direction and in a direction away from the surface of the sheet accommodator.

23. The feeding device according to claim 20, further comprising a clearance defining member which is disposed between the dust-remover supporter and the surface of the sheet accommodator, and which is spaced apart from the first contact portion of the dust-remover supporter so as to cooperate with the first contact portion to define a clearance, wherein the inclined portion of the plate member is received in the clearance, and wherein the clearance defining member is spaced apart from the first contact portion by a distance that is larger than a thickness of the inclined portion of the plate member, so as to allow pivot motion of the plate member received at the inclined portion thereof in the clearance.

24. The feeding device according to claim 23, wherein the sheet accommodator is provided by a sheet supply tray which has a surface on which the sheets are to be piled, and wherein the clearance defining member is provided by a guide member which is disposed on the surface of the sheet supply tray and which has a guide surface extending in the feed direction.

25. A feeding device capable of feeding sheets one after another in a feed direction, comprising:

a sheet accommodator capable of accommodating the sheets piled therein;

a dust remover including a contact portion, which is held in contact with a surface of an uppermost one of the sheets piled in the sheet accommodator, irrespective of the number of sheets remaining in the sheet accommodator, so as to remove dust from the surface of the uppermost sheet that is fed from the sheet accommodator in the feed direction; and an opening definer defining an introduction opening through which the sheets are to be introduced into an inside of the feeding device, wherein the dust remover includes a portion which covers the introduction opening, and wherein the dust remover includes an introduced portion which is introduced through the introduction opening into the inside of the feeding device.

26. The feeding device according to claim 25, wherein the sheet accommodator has a surface on which the sheets are to be piled and along which the sheets are to be fed in the feed direction, and wherein the introduced portion of the dust remover is introduced through the introduction opening such that the dust remover is substantially unmovable relative to the opening definer at least in a sheet-width direction which is parallel with the surface of the sheet accommodator and which is perpendicular to the feed direction.

27. A dust remover, which is provided by a plate member formed of an elastic material and to be incorporated in a feeding device capable of feeding sheets one after another in a feed direction, the feeding device including a sheet accommodator capable of accommodating the sheets piled therein, and an opening definer opening an introduction opening through which the sheets are to be introduced into an inside of the feeding device, the dust remover comprising:

a contact portion, which is held in contact with a surface of an uppermost one of the sheets piled the sheet accommodator so as to remove dust from the surface of the uppermost sheet that is fed from the sheet accommodator in the feed direction; and a portion, which covers the introduction opening;

the dust remover being provided by a plate member which is formed of an elastic material, wherein the plate member has opposite end portions opposite to each other in a first direction thereof, wherein one of the opposite end portions provides a contact end portion that is to be held in contact with the surface of the uppermost sheet, and wherein the other of the opposite end portions is at least partially inclined so as to provide at least one inclined portion introducible through the introduction opening into the inside of the feeding device.

28. The dust remover according to claim 27, wherein the other of the opposite end portions of the plate member provides a pair of inclined portions as the at least one inclined portion which are spaced apart from each other in a second direction perpendicular to the first direction, and wherein a distance between outer ends of the respective inclined portions as measured in the second direction satisfies the following expression (1):

$$H4 \leqq H3 \quad (1),$$

wherein "H4" represents the distance between the outer ends of the respective inclined portions, and "H3" represents a dimension of the introduction opening.

29. The dust remover according to claim 28, wherein the distance between the outer ends of the respective inclined portions satisfies the following expression (2):

$$H3 - H4 \leqq \text{about } 2(\text{mm}) \quad (2),$$

wherein "H4 " represents the distance between the outer ends of the respective inclined portions, and "H3" represents the dimension of the introduction opening.

* * * * *